United States Patent [19]

Norman

[11] 3,990,463

[45] Nov. 9, 1976

[54] PORTABLE STRUCTURE

[76] Inventor: Lowell Robert Norman, 4902 Secor Road, Toledo, Ohio 43623

[22] Filed: Oct. 17, 1975

[21] Appl. No.: 623,547

[52] U.S. Cl. ..... 135/4 R; 135/1 R; 135/14 V

[51] Int. Cl.[2] ..... A45F 1/16

[58] Field of Search ..... 135/1 R, 4 R, 3 R

[56] References Cited

UNITED STATES PATENTS 3,675,667 7/1972 Miller ..... 135/4 R X

*Primary Examiner*—Werner H. Schroeder
*Assistant Examiner*—Conrad L. Berman

[57] ABSTRACT

Disclosed is a portable structure having principal utility as a tent. The support for the structure comprises a continuous loop of a flexible, coilable, resilient material such as flat spring steel stock. The support is secured to the fabric of the structure at at least a plurality of points and preferably is continuously held thereto in an elongate pocket. In use, the support is restrained by and supports the fabric and is held in a "figure-eight" configuration with the cross-over of the figure eight as the apex of the structure and the loops of the figure eight extending downwardly therefrom and where most remote are at the base of the structure thereby providing a measure of support for the structure. The support provided by the frame alone is substantially increased by the co-action of the body of the structure which, in use, provides additional lateral stability to the structure and puts the frame in compression thereby considerably increasing its rigidity. The frame member, being flexible and coilable can be readily collapsed and stored when the structure is not in use.

7 Claims, 11 Drawing Figures

FIG 5
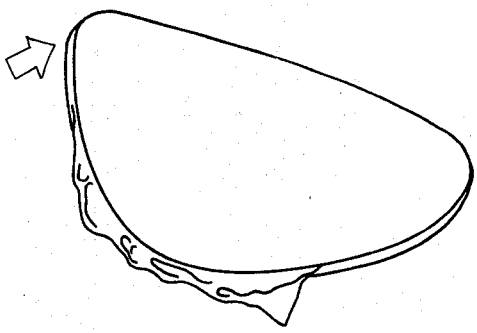
FIG 6
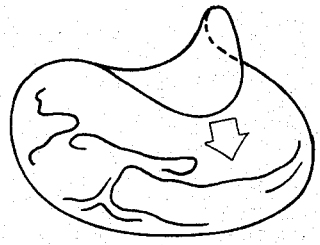
FIG 7
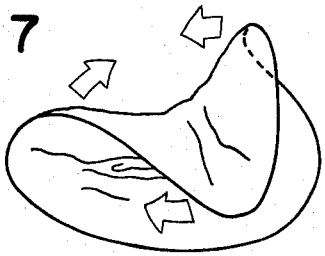
FIG 8
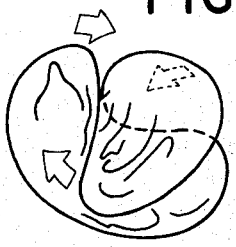
FIG 9
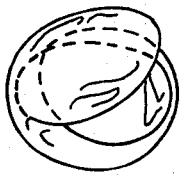
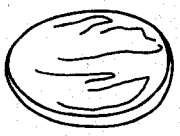
FIG 10
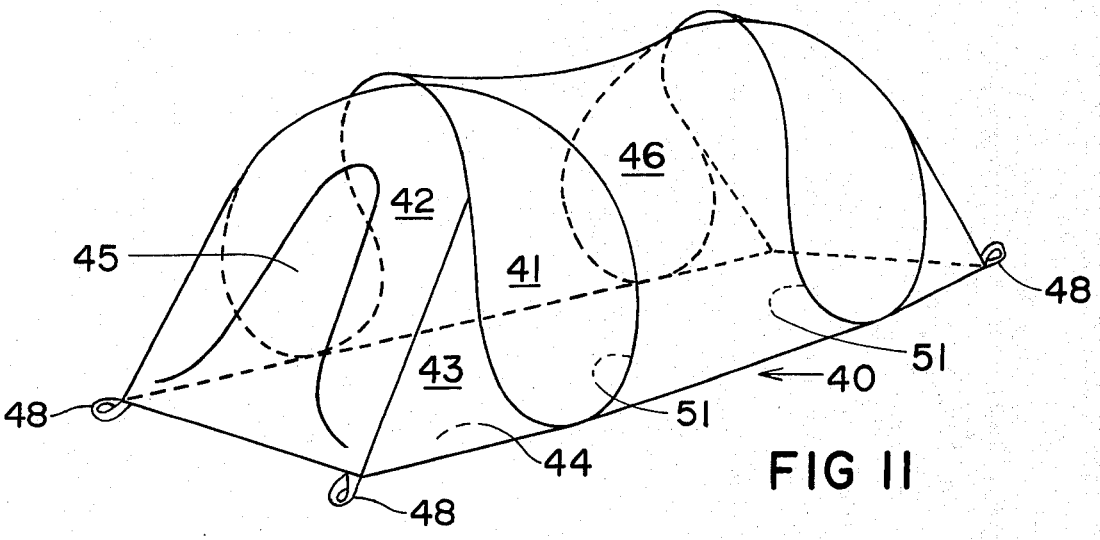
FIG 11

PORTABLE STRUCTURE

CROSS-REFERENCE TO RELATED APPLICATIONS

A related structure is disclosed and claimed in my co-pending U.S. patent application, Ser. No. 520,961 filed Nov. 5, 1974, now U.S. Pat. No. 3,960,161.

BACKGROUND OF THE INVENTION

This invention relates to structures and more particularly to portable structures suitable for shelters such as tents.

Portable structures such as tents have existed for centuries and have always presented problems of various types. One of the principal problems with portable structures is that associated with erecting them. The supports for most portable structures are comprised of a plurality of individual pieces which can be readily lost and which require a substantial amount of time to assemble. Also, erecting portable structures is a generally difficult and sometimes impossible task for one person.

Some attempts have been made to simplify the task of erecting portable structures. As exemplified by the "umbrella" type tent, these attempts have generally resulted in heavier and still more complex structures. These consequences have prevented prior art easy erecting structures from gaining broad popularity.

It is therefore, an object of the present invention to provide an improved portable structure.

It is further an object of this invention to provide such a structure which is extremely simple to manufacture and light in weight.

It is still a further object of this invention to provide such a structure which can be erected readily by a single person and, in fact, can best be described as self-erecting.

SUMMARY OF THE INVENTION

The above and other objects are realized by the provision of a structure which, in general terms, comprises a frame of a flexible coilable resilient material which in its in-use position is generally in the shape of a figure eight. The cross-over of the figure eight forms the apex of the structure and the loops of the figure eight extend downwardly therefrom and, where most remote from the apex, are at the base of the structure. Normally the two loops of the figure eight are of equal size and symmetrically disposed.

The frame, as described above, is held in the desired in-use configuration by the body, or fabric, of the structure and more particularly by securement at at least a plurality of points between the fabric and the frame. In the illustrated preferred embodiment, an elongate pocket is formed with or as part of the fabric of the body to retain the frame thereto along its entire length.

The structure will typically be in the form of a tent and will be so referred to hereinafter, it being expressly understood that other forms and uses are within the scope of the contemplated invention. The structure can have, for example, utility as a sun-screen for use on the deck of a boat. In each such alternate application the use will dictate design details and variants within the spirit of the following description of the preferred embodiments of the invention and the scope of the appended claims.

The body or fabric of the tent spans across the figure eight of the frame and forms a pair of opposing side panels for the structure. Depending on the overall geometry, these side panels may be on either the short or long sides of the structure. Additional panels of fabric span between those within the figure eight and form therewith a generally four-sided structure. The last-mentioned panels (referred to herein as end panels) normally extend all or substantially all the way to the ground and extend oppositely and laterally outwardly away from the apex of the structure. Means, such as tie members, are provided to pull the end panels downwardly and outwardly away from the apex of the structure. Pulling downwardly and outwardly on the end panels tensions the side panels and puts the frame member in compression thereby forming a very rigid structure even though the frame member alone is quite light and flexible.

The structure can be readily collapsed into a small convenient size for transporting and being erected simply by one person. The frame member is unitary and of very light weight for a given size tent thereby obviating two of the major problems of the prior art.

More complex structure involving multiple support members of the same type are also possible and one alternate configuration is described.

BRIEF DESCRIPTION OF THE DRAWINGS

While the specification concludes with claims which particularly and distinctly point out the invention it is believed that the same will be better understood with reference to the following description of the preferred embodiments taken in conjunction with the accompanying drawings in which:

FIGS. 4–9 illustrate the manipulation of the frame member to "collapse" the structure;

FIG. 10 is an isometric view of the structure of FIG. 1 in its collapsed condition; and FIG. 11 is an isometric view of an alternate of the invention.

DESCRIPTION OF THE PREFERRED EMBODIMENTS

Figure 1:
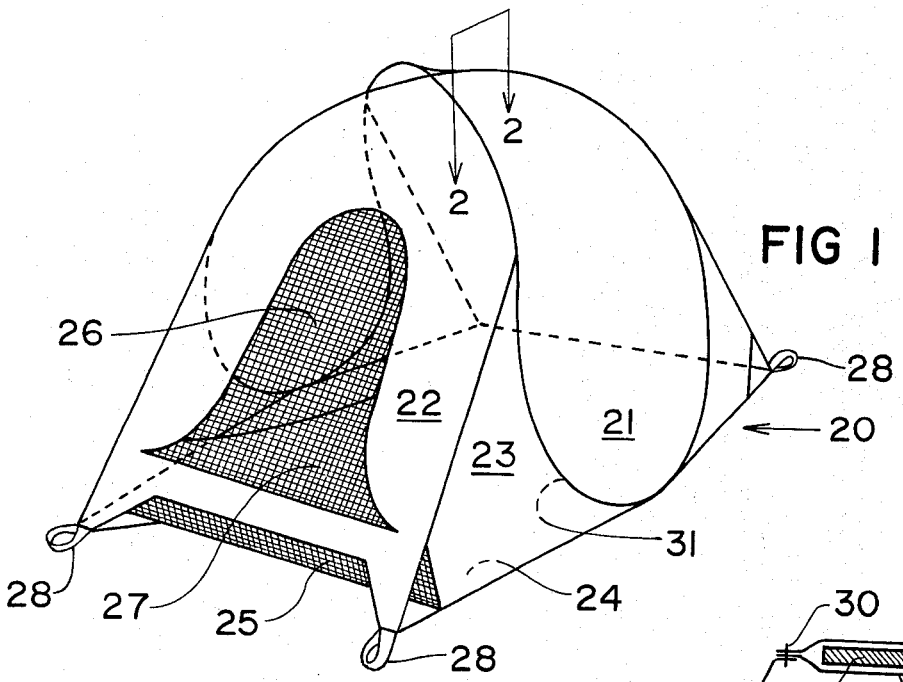
FIG. 1 is an isometric view of a simple tent structure of the present invention.

FIG. 1 of the drawing illustrates the present invention in a simple preferred configuration. The structure is that of a tent which can be of any size but which will commonly be of such a size to accommodate one or two persons.

Any convenient fabric-like flexible sheet material can be used for the body forming panels 21, 22 and 23 of the structure 20. Preferred are materials commonly used in tent and other portable structures. Strong, light weight materials such as those made from fibers produced by E. I. Du Pont de Nemours and sold under the trademarks Nylon and Dacron are particularly preferred.

A number of essentially standard features are employed, varying somewhat with personal preference. A passageway is provided in one or more places on the body of the tent 20 to provide for ingress and egress. Any suitable passageway can be used and is preferably located in the end panel 22 of the tent.

Figure 3:
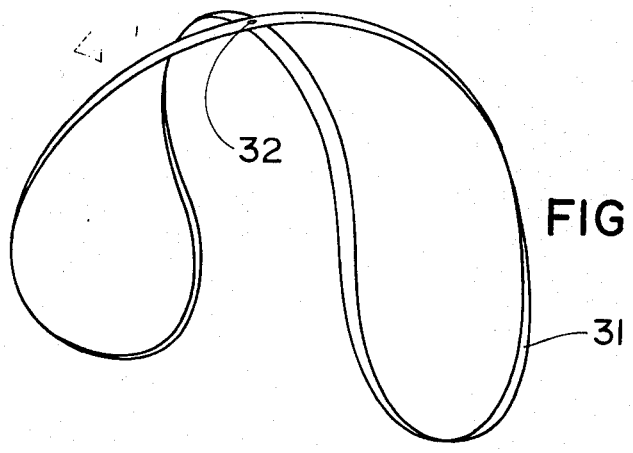
FIG. 3 is a view of the support member of the structure of FIG. 1.

The tent of the present invention has a shape largely determined by the frame member 31 as will hereinafter more fully be described. With reference to FIG. 3 which shows the frame 31 in its in-use position but without the fabric of the tent, it can be seen that the frame 31 can best be described as being figure-eight shaped. The cross-over of the figure-eight is at the apex of the structure while the loops of the frame material proceed downwardly therefrom and, where most remote therefrom, are at the base of the structure.

The frame 31 comprises a closed loop of material which is relatively strong and yet is flexible to a sufficient degree to allow it to be coiled. Further, the frame material should be springy in nature and is preferably anisotropic; e.g. by being non-symmetrical about its longitudinal axis. The preferred material for the frame 31 is flat spring steel stock and is preferably of stainless steel so as to be impervious to the elements. Plated or coated spring steel stock can also be used. Other materials useable for the frame include flat plastic materials having relatively high bending moduli and generally oval plastic tubing of such materials. Round or square tubing or solid stock, while less preferred, can also be employed.

Figure 2:
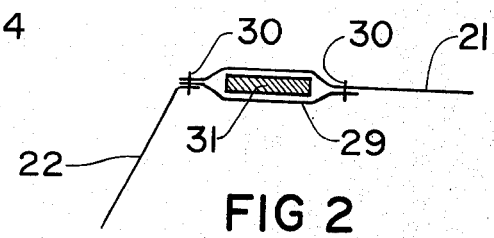
FIG. 2 is a cross sectional view of the frame member taken along line 2—2 of FIG. 1.

For the tent shown in FIG. 1 having an approximate length of 8 feet, height of 4 feet and width of 5 feet, the preferred frame member is a flat spring steel stock having a thickness of about 0.050 inch and a width of ½ inch. With continuing reference to FIG. 2, it can be seen that the frame member 31 is held relative to the fabric of the panels 21 and 22 by a retaining means comprising a strip 29 of fabric similar to that used for the remainder of the tent and is secured thereto by stitching 30. Preferably, the strip 29 is continuous along the frame and forms, together with the adjacent panels, an elongate pocket for locating the frame 31. Although less preferred, and not illustrated, the retaining means can also comprise a plurality of discrete strips spaced along the frame 31. The frame member 31 is preferably formed with a single 360° twist, particularly when it is formed of a flat stock. The ends of the strip of material forming the frame are first brought together as if to form a simple untwisted loop. One of the ends is then rotated 360°, relative to the other end, about the longitudinal axis of the strip. The ends are thereupon secured together by any suitable means such as overlapping and riveting them. The loop, so twisted, has a free unconstrained shape comprising a continuous double loop. The two loops, which form the two loops of the figure-eight in use, can be secured together by a rivet (see FIG. 3) 32 which aids in maintaining the shape of the structure but must allow a scissor-like motion between the frame parts.

Side panels 21 span within the loops of the frame member 31 and form at least a part of the sides of the tent. Panels 21 are generally tear-drop in shape to match the shape of the loops of the figure-eight. As can be appreciated, the shape of the loops of the frame can vary from circular for an unconstrained frame to a very long narrow shape with considerable constraint. For most purposes it is preferred that the loops, in use, be about 1½ to 2½ times as long from the apex of the structure to the ground as they are at their greatest horizontal extent. In use the side panels 21 are in tension and the frame 31 is in compression, as will be more fully described, forming a structure with considerable strength in view of its light weight.

Returning to FIG. 1, end panels 22 are provided spanning between the side panels 21 to form therewith a four sided structure. Normally, and as shown, the end panels 22 extend from the apex of the structure to or near the base of the structure. At the base, the end panels 22 are spaced laterally apart and extend well beyond the frame. Additional side panels 23 are provided to span between the lower portions (in use) of the side panels 21 and end panels 22. Tie members 28 are provided at the lower corners of the structure and are so located to provide a downwardly and outwardly directed pull on the frame 31 and side panels 21.

Tightly securing the tie members 28 to the ground tensions the side panels 21 which, in turn, puts the frame member 31 in compression thereby providing a relatively rigid structure. In addition, the use of tie members 28 stabilize the frame 31 and holds it and the remainder of the structure upright which the frame 31 alone cannot do.

A floor panel 24 is attached to the various panels 21, 22 and 23 along the lower edged thereof to provide additional protection against the elements and insects. The floor panel 24 also further strengthens the structure of the present invention by restraining the lower portions of the frame member 31 against further movement outwardly relative to each other.

The doorway of the structure shown in FIG. 1 is of generally conventional design and comprises a bell shaped cutout in the end panel 22 with a pair of zipper halves secured along each side thereof. A fly-screen 26 is sewn along the lower edge of the opening and includes mating zipper halves along each side to releasably hold the screen over the opening as shown. A door panel 27, shown substantially in the open position, the closed portion being visible through the screen extending about 40% up the right edge of the opening and about 10% up the left edge of the opening, is secured to the lower edge of the opening inside the screen 26 and is also equipped with zippers along its bell shaped edges for mating with the other set of zipper halves on the end panel 22 for closure.

Ventilation of the tent 20 is also provided by screening 25 at the lower portion of the end panels 22. The end panels 22 include a cut out area adjacent the ground to allow air to pass under but extend downwardly and outwardly from the top of the screen 25 to provide an "awning" therefor. It is possible and will be desirable in many applications to include additional such features in combination with the basic structure.

Figure 4:
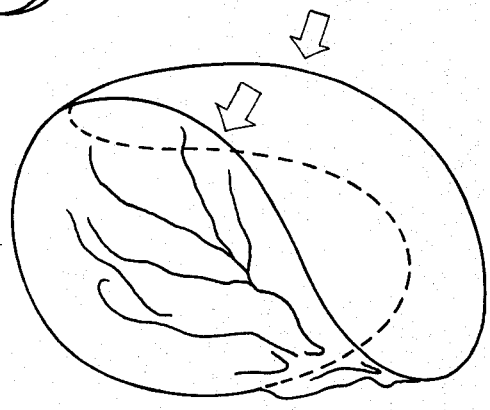

FIGS. 4–9 illustrate the sequence for collapsing the structure of FIG. 1 for transporting. The stakes securing the tent to the ground are removed and the tent placed on one side as shown in FIG. 4. The panels 22 and 23 and the floor 24 are first stuffed between the side panels 21. The upper portions of the frame member 31 are then pushed downwardly, as indicated by the arrows, toward the lower portions thereof. The frame member portions then pop into the saddle shaped configuration shown in FIG. 5.

Next, an upwardly directed portion of the frame loop, as seen by the person collapsing the structure, is pulled toward and held generally adjacent the opposite side of the loop as shown by the arrows in FIGS. 5 and 6. Following this, the other sides of the loop are pushed together as shown by the opposing arrows on FIG. 7 causing the near upper portion, as illustrated, to tuck inside the remainder of the structure as indicated by the third arrow. The process continues as shown in FIG. 8, by pushing one of the frame portions being manipulated (dashed arrow) inside the other. This continues the automatic tucking of the near portion and the collapse completes essentially by itself through the position shown in FIG. 9 and to the fully collapsed condition shown in FIG. 10.

FIG. 11 illustrates a tent according to the present invention which uses two frame members 51, each generally like the frame members 31 described previously. Side panels 41 are within the loops of the frame member 51. End panels 42 include an opening for a door 45 and the members 48 are provided at the lower corners of the end panels 42 for securement to the ground. Additional side panels 43 bridge between the end panels 42 and side panels 41. Connecting panel 46 spans between the two frame members 51 to complete the upper portion of the structure. A floor panel 46 is also provided and is secured along the lower edges of the various other panels. The structure of this or other variations employing multiple frame members is collapsed by collapsing each of the frame members 51 individually in the manner described previously.

Many other variations will occur to those skilled in the art based on the foregoing description of the preferred embodiments which are illustrative and not limiting.

What is claimed is:

1. A portable structure comprising a frame of a flexible coilable material, said frame having a shape of a figure-eight with the cross-over thereof forming the apex of the structure and the loops thereof extending downwardly therefrom; first and second panels of material spanning within and affixed at at least several points on their periphery to the two loops of the frame respectively and comprising first and second sides for the structure; third and fourth panels of material spanning between and affixed to at least a portion of their periphery to said first and second panels and forming therewith a four sided structure and means adapted to tension said first and second panels by pulling said frame downwardly and outwardly whereby said structure is strengthened and supported and can be readily collapsed.

2. The structure of claim 1 wherein said frame is comprised of flat spring steel stock.

3. The structure of claim 2 wherein said frame includes a single 360° twist.

4. The structure of claim 1 wherein said third and fourth panels extend downwardly and outwardly from the apex and terminate at the same elevation as the lower ends of said loops and further comprising additional side panels between said first mentioned side panels and said end panels and a floor secured along the lower edges of each of said panels.

5. The structure of claim 4 wherein said means for tensioning comprises tie members at the lower corners of said end panels.

6. The structure of claim 5 wherein said frame is comprised of flat spring steel stock.

7. The structure of claim 6 wherein said frame includes a single 360° twist.

* * * * *